US007020980B1

(12) United States Patent
Adams et al.

(10) Patent No.: US 7,020,980 B1
(45) **Date of Patent: *Apr. 4, 2006**

(54) VACUUM TREATMENT OF WASTE STREAM WITH ANTI-INCRUSTATION MEASURES

(75) Inventors: Randall G. Adams, Carthage, MO (US); Marshall R. Franklin, Carthage, MO (US)

(73) Assignee: Micronics, L.L.C., Carthage, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/751,304

(22) Filed: Jan. 2, 2004

Related U.S. Application Data

(63) Continuation-in-part of application No. 10/269,920, filed on Oct. 12, 2002, now Pat. No. 6,754,978.

(60) Provisional application No. 60/329,089, filed on Oct. 13, 2001, provisional application No. 60/510,940, filed on Oct. 14, 2003.

(51) Int. Cl.
*F26B 3/08* (2006.01)

(52) U.S. Cl. ..... 34/361; 34/92; 159/47.3; 159/DIG. 16; 71/11

(58) Field of Classification Search ..... 159/2.1, 159/DIG. 16, DIG. 28, 47.3; 422/309, 33, 422/32, 5, 1; 110/204, 224, 342; 71/11; 34/361, 92
See application file for complete search history.

(56) References Cited

U.S. PATENT DOCUMENTS

| | | | | |
|---|---|---|---|---|
| 1,945,860 A | | 2/1934 | Laffler | 426/299 |
| 3,724,090 A | | 4/1973 | Smith, Jr. | 34/57 D |
| 4,082,856 A | | 4/1978 | Zwiep et al. | 426/299 |
| 4,191,102 A | | 3/1980 | Cope | 99/580 |
| 4,308,290 A | | 12/1981 | Fujii | 426/299 |
| 4,731,164 A | | 3/1988 | Williamsom | 202/173 |
| 4,738,779 A | | 4/1988 | Carroll et al. | 210/512.2 |
| 5,053,238 A | | 10/1991 | Zeidler et al. | 426/299 |
| 5,129,993 A | * | 7/1992 | Bleeker | 159/47.3 |
| 5,185,087 A | | 2/1993 | Lister et al. | 210/787 |
| 5,421,645 A | | 6/1995 | Young | 312/108 |
| 5,429,750 A | | 7/1995 | Steele | 405/129.25 |
| 5,462,661 A | | 10/1995 | Nasu | 210/206 |
| 5,507,958 A | | 4/1996 | White-Stevens | 210/774 |
| 5,772,901 A | | 6/1998 | Yu et al. | 210/138 |
| 5,951,947 A | * | 9/1999 | Hunt | 422/21 |
| 6,052,917 A | | 4/2000 | Matsumoto | 34/138 |
| 6,056,885 A | * | 5/2000 | Wasinger | 210/760 |
| 6,176,376 B1 | | 1/2001 | MacNeil | 209/510 |
| 6,344,217 B1 | | 2/2002 | Ruepp | 424/581 |
| 6,649,203 B1 | | 11/2003 | Thoroski | 426/299 |

* cited by examiner

*Primary Examiner*—Henry Bennett
*Assistant Examiner*—Camtu Nguyen
(74) *Attorney, Agent, or Firm*—Jonathan A. Bay

(57) ABSTRACT

A method of treating a waste stream comprises a vacuum treatment to promote disintegration of the waste material by "flash vapor" production, causing a swiftly vaporizing fraction inside the material to literally explode or shred apart the matrix of the material as a whole. A main processor operates at a level of vacuum that determines a given boiling temperature for a vaporizing fraction, and one which lower than the fraction's boiling temperature for the local vicinity's barometric pressure (eg., atmospheric pressure). The input stream is pre-heated to above the given boiling temperature for that fraction as determined by the main processor's vacuum level without, however, going over the boiling temperature for the local barometric pressure. It is then introduced into the vacuum of the main processor whereby a minor percentage of the vaporizing fraction flashes into vapor, and this presumptively promotes destruction and/or disintegration of the material.

10 Claims, 7 Drawing Sheets

VACUUM TREATMENT OF WASTE STREAM WITH ANTI-INCRUSTATION MEASURES

CROSS-REFERENCE TO RELATED APPLICATION(S)

This application is a continuation-in-part of U.S. patent application Ser. No. 10/269,920, filed Oct. 12, 2002, now U.S. Pat. No. 6,754,978, which claims the benefit of U.S. Provisional Application No. 60/329,089, filed Oct. 13, 2001.

This application also claims the benefit of U.S. Provisional Application No. 60/510,940, filed Oct. 14, 2003.

All the foregoing are incorporated fully herein by this reference.

BACKGROUND AND SUMMARY OF THE INVENTION

The invention relates to vacuum treatment of a waste stream and, more particularly, to vacuum treatment of a waste stream including at least a main processor provided with anti-incrustation measures. Treatment is preferably accomplished by utilization of such processes as and without limitation vacuum and heating processes, mechanical processes, as well as without limitation flash-vapor production and pneumatic-conveyance drying.

Nowadays a particular problem is emerging with what to do with livestock manure from high-density livestock operations. For example, consider the management issues surrounding avian manure. High-rise poultry houses, popular for egg-laying production, are copious producers of avian manure. There are various prior art measures for disposition of the manure, as discussed next. However, these measures are exhausting a particular resource and hence are approaching a kind of obsolescence.

Birds in high-rise chicken houses are kept in multi-story cages typically suspended from ceilings, and their manure is allowed to fall and collect on the floor. These days, disposal usually entails spreading the manure out over agricultural fields as a soil additive. The recently emerging problem with this is that, owners and operators are running out of fields. Historically, owners and operators of high-rise egg-laying houses have also owned a lot of surrounding acreage in fields for this purpose. Not only does this serve as an odor-buffer from the public, but the fields also provide the acreage necessary to accept a given amount of manure that will be spread across it.

To be sure, the manure serves as a wonderful soil additive. However, every field has only a limited capacity to accept so much manure. There becomes a point when too much is too much. Among other constraints on just how much manure the land can accept include those set by governmental oversight for environmental reasons. So, when an owner/operator wants to increase egg-laying capacity, there is a separate consideration that involves identifying additional acreage for spreading out the excess manure.

In other words, if an owner or operator wants to increase egg-producing capacity, constructing additional chicken houses requires not much land. A few dozen acres can support the housing for a truly astounding population of egg-laying hens (millions and millions!). Conversely, the land resource which is easily over-taxed is the acreage available for spreading out the manure. The owner/operators are certainly utilizing all their own nearby landholdings, as well as selling manure at discounted prices to all willing nearby buyers. Of course, the owner/operator can buy more land except that, expense aside, the amount of acreage needed is expansive. It probably won't be on the market. A counterpart solution is to haul excess manure over longer-distances, indeed it ship on a regular schedule to distributed sites, some maybe half way across the nation. At this stage of planning, manure logistics takes on a whole life of its own.

That brings all this to an obstacle. The economics of shipping might overwhelm the economics of simply choosing to build the new high-rise chicken houses at some distantly located site, perhaps halfway across the nation. That way, the new chicken houses can be sited amid an under-served local agricultural-field market for the manure.

What is needed is a solution to the shortcomings of the prior art which can render livestock manure sufficiently lightweight, finely shredded, compact, and substantially deodorized if not pathogen free, so that the logistics of shipping manure cost-compete better against the start-up costs of simply locating new houses at very distant locations.

To turn now to general matters of manure chemistry, manure comprises among other things protein, carbohydrate and fats/oils. Fats/oils and/or the fatty acids they derive from are among the more stable of organic compounds and are not easily decomposed by bacteria or reduced by heat. Indeed, from a cooking perspective, it is common knowledge that proteins and carbohydrates will cook in oils at temperatures which won't cook the oil.

The fats and oils present in manure comprise, not surprisingly, many of the same fats and oils found in livestock and/or their feed. Natural fats and oils are derivatives (or esters to be more accurate) of fatty acids. In general, esters are the products of acids reacted with alcohols or phenols. For example, ethyl alcohol and acetic acid react with the elimination of water to produce ethyl acetate, a volatile liquid with a pleasing fruity odor, and which is used as a solvent especially in lacquers. Animal fats consist mainly of the glyceryl esters of palmitic acid and stearic acid (ie., glyceryl palmitate and glyceryl stearate) and these predominantly form the solid fats. In contrast, glyceryl oleate, the glyceryl ester of oleic acid, is found in olive oil, whale oil and the fats of cold-blooded animals, and it tends to remain liquid at ordinary temperatures.

Fats and oils will be found to convert back to their parent fatty acid under certain circumstances, including by reaction with a mineral acid. However, these parent fatty acids contribute to among other problems the malodorous quality of manure (and along among other things hydrogen sulfide, ammonia, and mercaptans). Formic acid and acetic acid are the first two members of the series of fatty acids (or carboxylic acids to be more accurate). The next two are propionic acid and butyric acid. A hydroxy-propionic acid, lactic acid, is formed for example when milk sours and cabbage ferments. It gives the sour taste to sour milk and sauerkraut. Butyric acid is the principal odorous substance in rancid butter. And so on, with many other of these fatty acids being found in the wastes, by-products and manure of higher life forms. For example, human perspiration includes lactic acid, butyric acid, propionic acid, valeric acid. Chicken manure is known to comprise acetic acid, butyric acid, isobutyric acid, propionic acid and isovaleric acid. The following table gives some physical data for several of the fatty acids.

TABLE

| acid | melts (° C.) | boils (° C.) | boils (° F.) |
|---|---|---|---|
| acetic | 17 | 118 | 244 |
| propionic | −22 | 141 | 285 |
| lactic | 18 | —(n.1) | — |
| butyric | −6 | 164 | 327 |
| isobutyric | −47 | 154 | 309 |
| valeric | −35 | 187 | 369 |
| oleic | 14 | 300 | 572 |
| palmitic | 64 | 380 | 716 |
| stearic | 69 | 383 | 721 |

(n. 1): Lactic acid decomposes when heated to 80–100° C. at atmospheric pressure.
Linus Paulding, General Chemistry, (Dover Publications, New York), © 1970 Linus Paulding, Table 23-3 (eg., p. 756).

Linus Paulding, *General Chemistry*, (Dover Publications, New York), © 1970 Linus Paulding, Table 23-3 (eg., p. 756).

It is an object of the invention to crack or otherwise break or explode certain contaminant and/or odorous fractions of manure by flash-vapor production. Flash vapor production is akin to flash steam production. For the foregoing reason, the main processor is operated under a vacuum to enable formation of flash vapors. Consider an example flashing component as if it were water. Water at sea level boils of course at 100° C. (212° F.). However, at ½ an atmosphere (fifteen inches of mercury), water boils at 80° C. (~180° F.). Indeed as pressure is depressed further, water boils at even lower temperatures still. Hence it is possible to produce flash steam at relatively cool temperatures. Indeed, the lower the vacuum pressure, the more explosive and/or turbulent is the process of flash steam production, which among other things tends to rip the flashing input material to shreds.

The concepts of "flash steam" production and "flash drying" are different concepts despite being denominated with the common term "flash." Flash drying is a process by which material dries while suspended in a hot pneumatic carrier, as this promotes mixing and efficient heat transfer.

In contrast, the production of "flash steam" is a different phenomenon. When hot water under pressure is released to a lower pressure, part of it is suddenly evaporated, becoming what is known as "flash steam." The basic physics behind this includes that, when water is heated at atmospheric pressure, its temperature rises until it reaches 100° C. (212° F.), the highest temperature at which water can exist at atmospheric pressure. Additional heat does not raise the temperature, but converts the water to steam. The heat absorbed by the water in raising its temperature to the boiling point is called "sensible heat." The heat of water at the boiling temperature is called the heat of saturated condensate. Then heat required to convert water at boiling temperature to steam at the same temperature is called "latent heat."

Note that at pressures lower than atmospheric (eg., vacuum pressures), water boils at relatively lower temperatures. Conversely, the value of latent heat slightly (very slightly) increases with lower pressures although, for practical purposes, the latent heat of water can be considered a constant across pressures between atmospheric and pressure so low that water freezes. So, if saturated water at atmospheric pressure is introduced into a partial vacuum, a certain amount of sensible heat is released. This excess heat will be absorbed in the form of latent heat, causing part of the water to "flash" into steam. To illustrate with real world values, saturated water at atmospheric pressure has a heat content of about 100 kcal/kg (180 Btu/lb). If this condensate is introduced into a ½ atmosphere vacuum, its heat content instantly drops to 82 kcal/kg (147 Btu/lb). The surplus 18 kcal/kg (33 Btu/lb) evaporates or flashes a portion of the condensate into steam. The percentage that will flash to steam can be computed using the formula:

$$\%\ \text{flash stream}=[(S_h-S_l)\div H]\times 100, \quad (1)$$

where $S_h$=Sensible heat in the condensate at the higher pressure before discharge;

$S_l$=Sensible heat in the condensate at the lower pressure to which discharge takes place; and H=Latent heat in the steam at the lower pressure to which the condensate has been discharged.

Given that the latent heat of steam for ½ atmosphere is about five-hundred and fifty kcal/kg (one thousand Btu/lb), then the percentage of flash steam computes to about 3⅓ percent.

It is an aspect of the invention to utilize the phenomenon of flash vapor production to promote explosion or shredding of a pre-heated waste stream when introduced into a vacuum processor. The greater the differential in pressure between the pre-heater and the vacuum processor, the better because the activity is more explosive and turbulent, tending to rip the material to shreds as well as otherwise break the molecules of the flashing fractions.

It is a general object of the invention to reduce an input manure stream into a lightweight, finely shredded, compact, and substantially deodorized if not pathogen free output.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIGS. 1A and 1B tile together to form a block diagram of a method and apparatus in accordance with the invention for vacuum treatment of a waste stream, including providing one or more processors for carrying out the invention with anti-incrustation measures;

DETAILED DESCRIPTION OF THE PREFERRED EMBODIMENTS

Figure 1A:
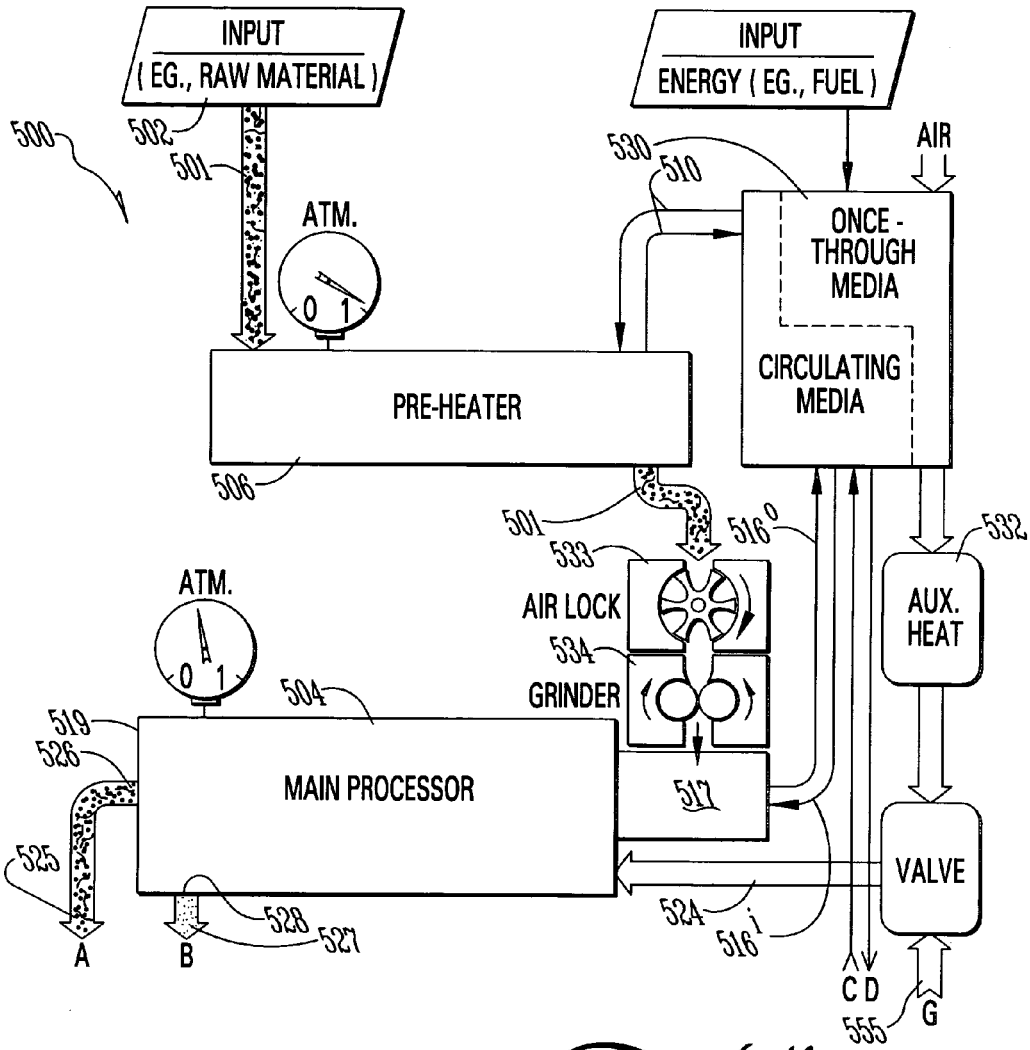
Figure 1B:
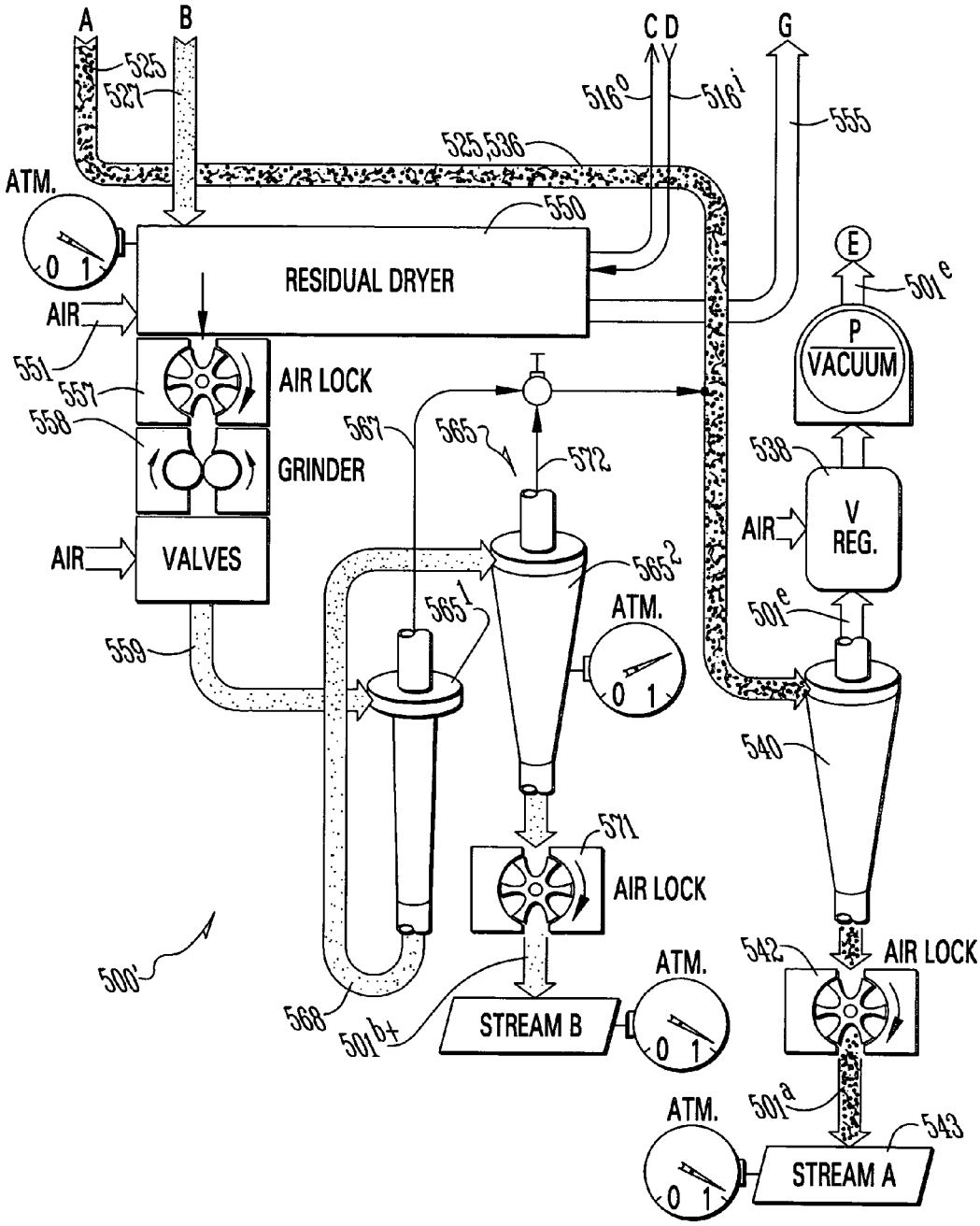

FIGS. 1A and 1B tile together to form a block diagram of a method and apparatus 500', 500 in accordance with the invention for accepting an input 501 of, for example, livestock manure and treating such until an output stream "A" 501$^{a}$ is obtained, as well as additional output streams such as "B" and "E," which are indicated by reference numerals 501$^{b}$ and 501$^{e}$ respectively.

At some original time a supply of raw input material is fed to the apparatus 500. For example, bulk shipment of material manure can be trucked in on roll-off containers, and then unloaded (as a dump truck) into some sort of bin or hopper 502 or the like, or else such as an auger-scoured U-trough. What is preferred is if the receiving bin, hopper or auger-scoured U-trough 502 and the like is adaptable to discharge the raw input material 501 in a measured stream 501 to initial stages of the inventive method and apparatus.

In a supporting role to a main processor 504, preferably an initial stage comprises a pre-heater 506. By way of background, the stream 501 of input material will normally contain a substantial amount of moisture and other vaporizable components, it being an object of the invention to evaporate that away to the extent practicable. It is one job for the pre-heater 506 to pre-heat the material stream 501 and so thereby ready it for flash vapor production in the main processor 504.

Figure 2:
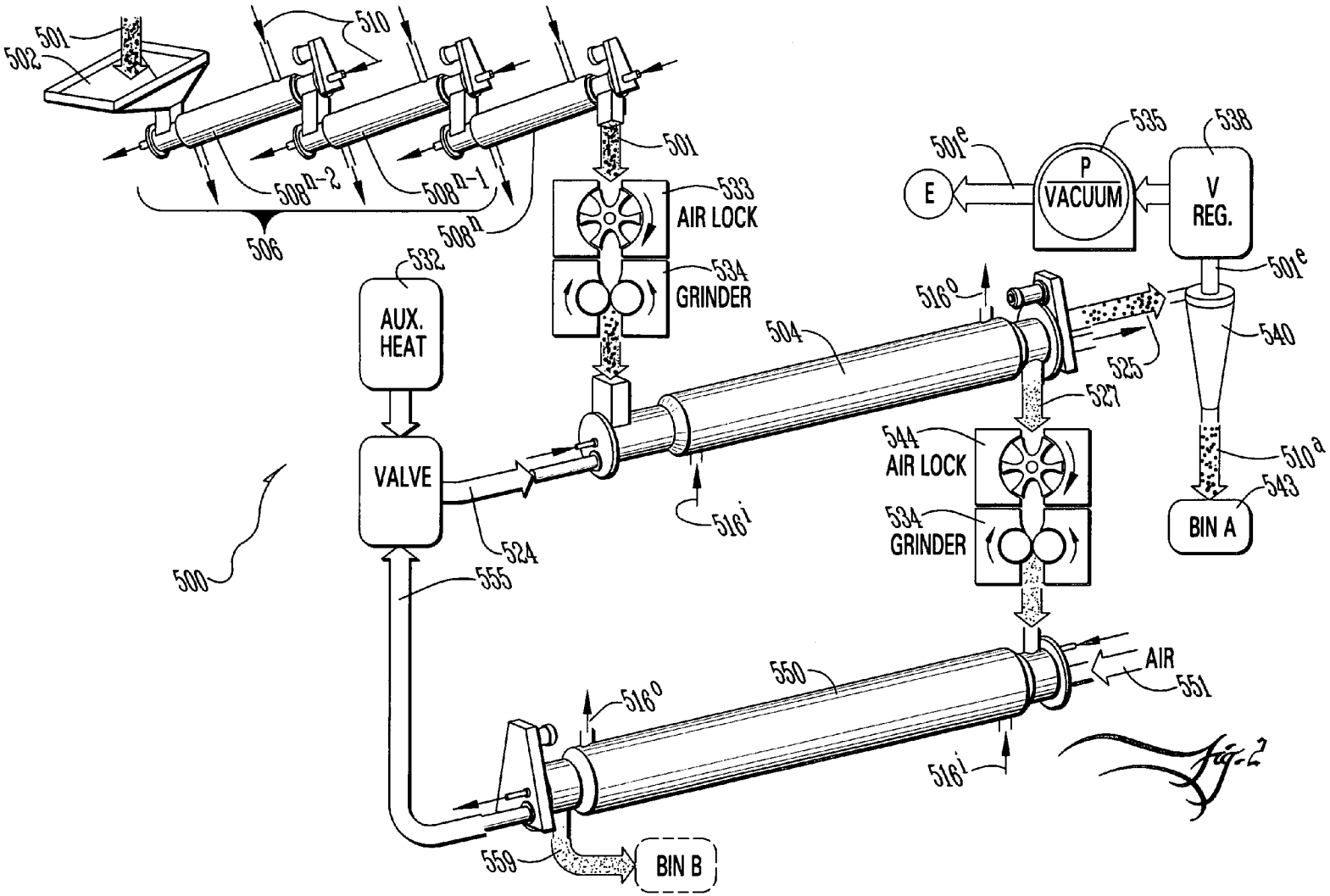
FIG. 2 is a schematic diagram, in contrast to block diagram, of aspects thereof.
Figure 3:
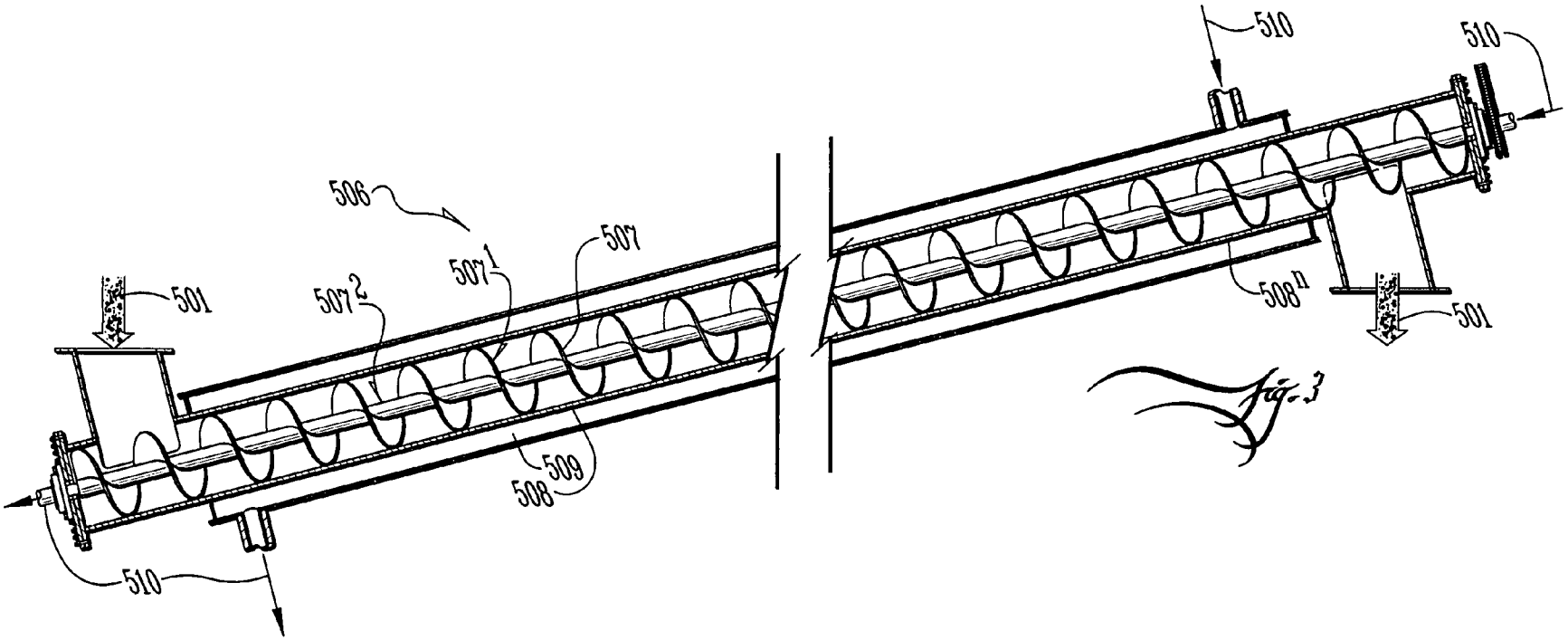
FIG. 3 is an elevational view, partly in section, of an example apparatus for carrying out the activities of a "pre-heater" as referenced in FIG. 1A.

With reference to FIGS. 2 and 3, a non-limiting example of a pre-heater 506 might comprise an auger 507 having a helical screw 507$^{1}$ formed around a hollow drive shaft 507$^{2}$ and situated inside a tight-fitting duct 508. It is preferred if the tight-fitting duct 508 has a jacket 509 to allow circulation of a thermal fluid 510 such as steam. It is additionally preferred to circulate the thermal fluid 510 through the hollow drive shaft 507$^{2}$. FIG. 2 shows that the pre-heater 506 might comprise more than one or two duct sections (eg., 508$^{n-2}$, 508$^{n-1}$ and 508$^{n}$) as shown in order to sufficiently produce the heat supply needed to bring the material 501 up to the desired temperature.

The output of the pre-heater 506 comprises the material stream 501 of course except warmed. This is inputted (or introduced) into the aforementioned main processor 504. As an aside, if the main processor 504 stands relatively high up off the ground, then the pre-heater 506—since it has the construction of one or more transfer augers—can be inclined to accommodate any elevation difference.

Moreover, as FIG. 2 shows, the pre-heater 506 is sealed, as its connection with the main processor 504. That way, any vapors cooked off the material 501 in the pre-heater 506 are suctioned/introduced into the main processor 504, ultimately destined for the end-of-the line exhaust stack 545 shown in FIG. 8, and to be further treated in accordance with what is more particularly described below in connection with FIG. 8.

Figure 4:
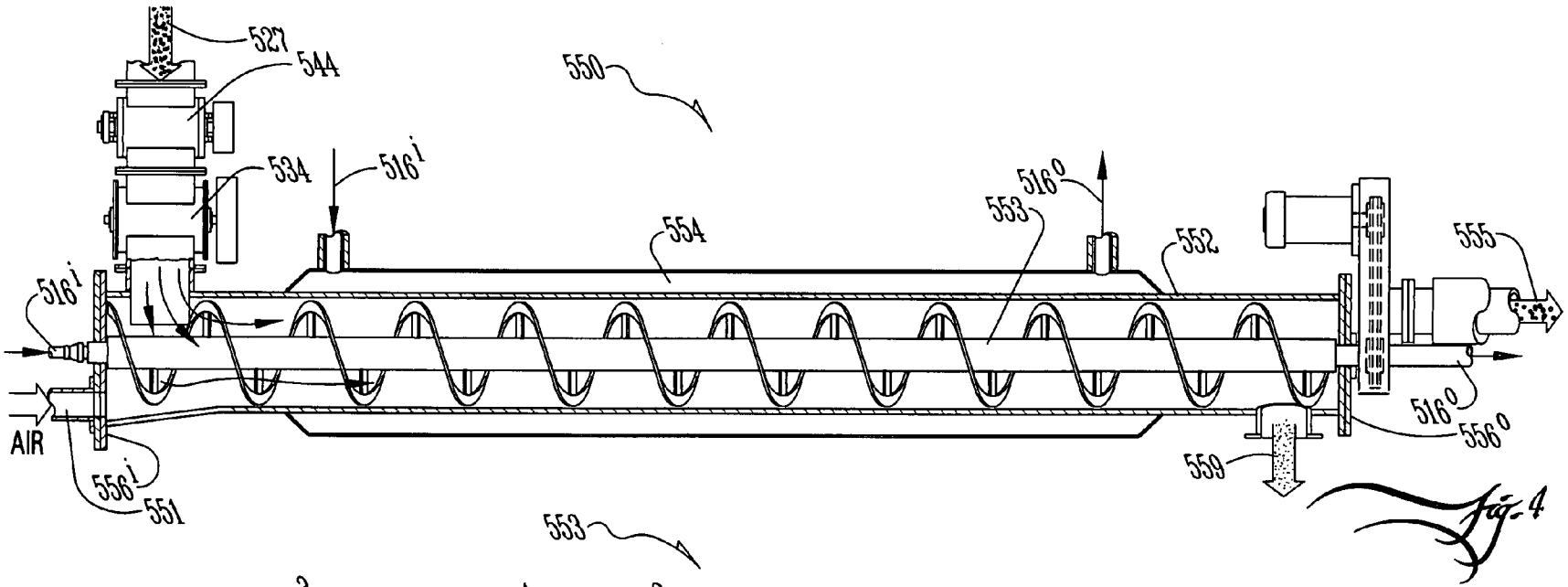
FIG. 4 is an elevational view, partly in section, of an example apparatus for carrying out the activities of a "main processor" as referenced in FIG. 1A.

With reference to FIGS. 2 and 4, a preferred construction for a main processor 504 comprises a duct 512 arranged horizontally and housing an internal auger 514. Since the main processor 504 is also heated, preferably the duct 512 is surrounded by a jacket 515 for circulating an appropriate thermal fluid 516$^{i}$, 516$^{o}$ (eg., steam). The auger 514 preferably has a hollow drive shaft 514$^{2}$ for circulation of a thermal fluid 516$^{i}$, 516$^{o}$ through it as well.

Figure 5:
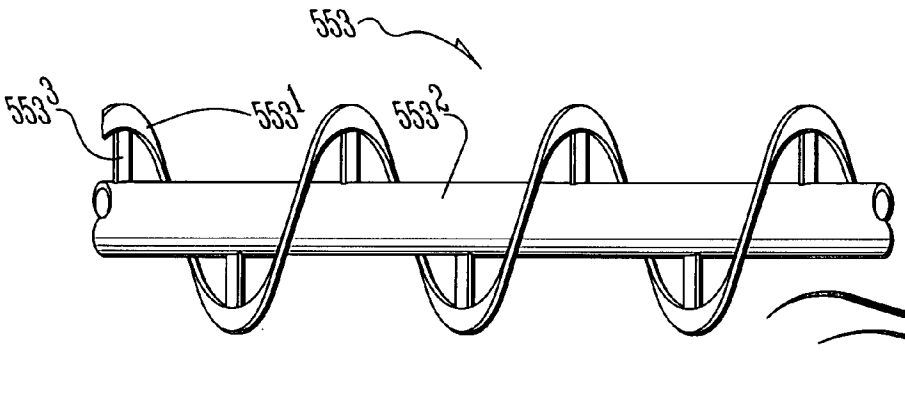
FIG. 5 is an enlarged scale perspective view of the ribbon auger thereof, in isolation and with portions broken away.

More generally, the duct 512 of the main processor 504 preferably extends between an introduction end 517 and an axially-spaced away discharge end 519. The auger 514's outer periphery essentially scrapes the duct 512's wall from end to end. FIG. 5 shows better that the auger 514 is more preferably a ribbon auger. That is, it has a ribbon screw 514$^{1}$ supported by a series of spokes 514$^{3}$ that support the ribbon screw 514$^{1}$ spaced away from the central hollow drive shaft 514$^{2}$. Not only does the ribbon screw 514$^{1}$ motivate material 501 in the direction toward the discharge end 519, it also scrapes gummy substances off the duct 512's inside wall while at the same time isolates the central drive shaft 514$^{2}$ from being coated by such gummy substances. The problem with such gummy or molasses-like accretions is that, if left unchecked in the heat, they will harden as hard as rock. Hence this ribbon screw 514$^{1}$ construction fights against such rock-like incrustation and accordingly this is referred to in part as an anti-incrustation measure. In sum, it is an inventive aspect to fight against the main processor 504 seizing to a halt because of unchecked rock-like incrustation of such gummy substances.

Figure 7:
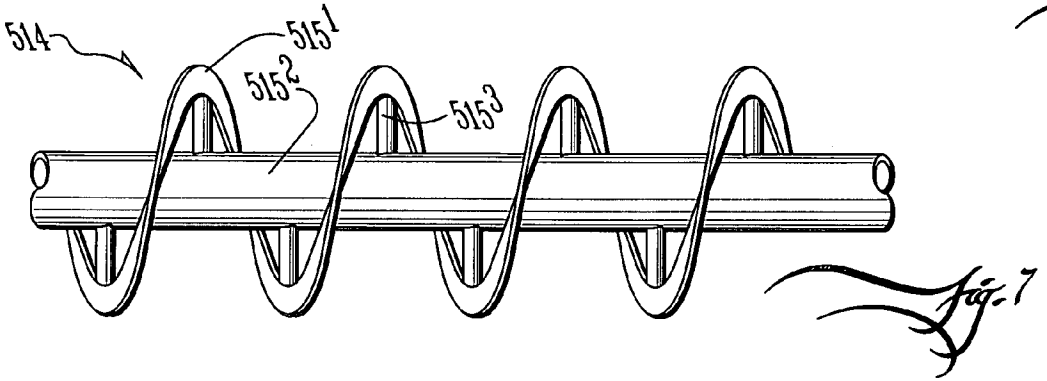
FIG. 7 is an enlarged scale perspective view of the ribbon auger of FIG. 6, in isolation and with portions broken away.

The spokes 514$^{3}$ are flat so that, unlike what will be disclosed in connection with a residual processor 550 in FIG. 7, there is no meaningful tumbling and/or cut-and-fold action developed by the spokes 514$^{3}$.

An example main processor 504 might measure without limitation about 3 meters (ten feet) long. The duct 512 preferably has an inside diameter of about sixty cm (twenty-four inches I.D.). An example auger 514 might have a thirty cm (twelve inch) pitch. It may be noted that this corresponds to a fairly "fine" thread, it being more customary in the design of augers to make pitch equal to outside diameter. If the auger is driven at a speed about five r.p.m., then the auger 514 very generally pushes non-suspending residual material 527 across its effective length in about two minutes. Longer residence times can be obtained by slowing down the speed of the auger 514.

The introduction end 517 is adapted to receive the warm input material 501 continuously along at the same time with a continuous injection or influx of a "pneumatic carrier," ie., a hot dry clean gas 524. The main processor 504's discharge end 519 is adapted to discharge (i) a "pneumatic stream" 525 out a vacuum port 526 as well as (ii) discharge a residual stream 527 out a drain 528. FIG. 4 shows the pneumatic carrier 524 being introduced through an inlet port 529 that is located at a relatively low elevation on the introduction end 517. In contrast, the input material 501 is introduced from directly overhead. This arrangement helps promote mixing. Additionally, FIG. 4 shows the vacuum port 526 to comprise simply an aperture in the discharge end 519.

Given the foregoing, it is an aspect of the invention that the main processor 504 is held under a partial state of vacuum. FIGS. 1*a* and 1*b* include various mock vacuum gauges to provide a relative comparison of the level of vacuum in the various vacuum as well as non-vacuum components of the apparatus 500. A suitably high power source of vacuum will be described more particularly below. Hence the main processor 504 has the following streams entering and, after interaction, exiting it. The introduction end 517 accept(s) a wet or moist, warm stream of pre-heated input material 501 as well as a stream of a hot dry clean gas 524. By the time the gas or "pneumatic" carrier 524 exits the main processor 504 as predominantly through the vacuum port 526 it additionally carries with it a vapor content that has been vaporized out of the input material 501, as well as a weight fraction of suspended, entrained or waftable materials. For convenience of terminology, this circumstance is referred to as the "pneumatic conveyance" of such suspended, entrained or waftable materials, regardless if the conveying gas is not truly air but something else. The vapor content comprises water vapor and other vapors of boiled or evaporated constituents.

Again, the main processor 504 admits the input material 501 as well as an intake stream of a pneumatic carrier 524 preferably comprising a hot and substantially clean and dry gas. The main processor 504 discharges a pneumatic stream 525 out through the vacuum port 526 comprising not only the pneumatic carrier 524 but also a vapor fraction and a weight fraction of entrained, suspended or waftable materials which represents a sizable majority weight fraction of the inputted material 501. The main processor 504 additionally discharges a non-suspending residual stream 527 out through the drain 528, which represents a small minority weight fraction of the inputted material 501.

A preferred source of the "pneumatic carrier" 524, or in other words a hot dry clean gas, is the flue gas exhaust from a propane boiler 530 that might be utilized to produce the steam (or whatever hot thermal circulating fluid 510, 516 might be alternatively used) for the thermal components of the inventive method and apparatus. Looking ahead to FIG. 6, it comprises a residual dryer 550 for the residual stream 527, and it likewise has a pneumatic carrier 551 (truly, in this instance, air) flowing through it. The residual dryer 550's pneumatic exhaust 555 is a useful hot clean gas, and sufficiently dry or un-saturated of other vapors, to introduce into the main processor 504. For energy conservation purposes, the residual dryer 550's pneumatic exhaust 555 is mixed with the propane boiler 530's exhaust and such a mixture comprises the heated pneumatic stream 524 that is introduced into the main processor 504. At times when the boiler 530's propane combustion is switched OFF, the intake gas might be alternatively obtained from pre-heated air as simply as by suctioning it in from the ambient environment (eg., the room) through an auxiliary heat exchanger 532 prior to introduction into the main processor 504's duct 512. The heat source for auxiliary heat exchanger 532 might comprise without limitation any of the following. That is, the heat source might comprise electric resistance heaters. Alternatively, it might comprise the steam condensate return 516$^{o}$ from the main processor 504 (in contrast to the steam input 516$^{i}$). The outflow of the pneumatic stream 525 is suctioned through the vacuum port 526, as previously stated, and this suction is ultimately pulled by a large vacuum pump 535.

In order to introduce the wet and warm input material 501 into the main processor 504 without losing the vacuum, it is introduced by way of through an air-lock gate 533. An example air-lock gate 533 has body forming cylindrical cavity and sandwiched between opposed flat end-plates. The cavity houses a vane gear that is driven to rotate such that material 501 introduced in the top falls into the vanes, and is rotated by the vanes to drop out through an open bottom. The vanes form a seal by scraping between the opposed flat end-plates as well as scraping past cavity's cylindrical sidewall.

It is preferred to grind up the output of the air-lock gate 533 in order to break apart clumps and the like. An example grinder 534 comprises a flailing-type grinder, as having counter-rotating grinding wheels, each which bristles with an array of spokes. The grinder 534 is driven up to speeds of eight-hundred and fifty r.p.m.

The main processor 504 can be reckoned as, to use terms of art, a hybrid of a rotary dryer and a flash dryer. The ribbon auger 514 and heated duct 512 walls are constructed predominantly in the fashion as a rotary dryer. In contrast, the open spaces provided by the spokes 514$^{3}$ and ribbon-screw 514$^{1}$ of the auger 514 allow processes to take place predominantly according to the principles of a flash dryer, in which suspended particles are pneumatically conveyed in the hot pneumatic carrier 524.

The main processor 504 is operated under a vacuum to both accomplish boiling as well as formation of flash vapor to occur at a relatively cooler temperature. For example, butyric acid at sea level boils at 164° C. (327° F.). However, at forty-percent of an atmosphere (ie., 40%, or twelve inches of mercury), butyric acid boils at 135° C. (~275° F.). Indeed as pressure is depressed further, butyric acid boils at even lower temperatures still. Hence it is possible to produce flash vapor of butyric acid by raising its temperature to nearly that of saturated condensate (eg., ~164° C. or 327° F.) and then introducing it into a vacuum. Indeed, the lower pressure the vacuum, a greater fractional percentage of the introduced butyric acid will flash upon introduction into the vacuum. Indeed, operating as low of a vacuum pressure as possible apparently produces more "turbulent" (eg., violent?) flash-vapor production, because it is observed that the lower the vacuum pressure the more ripping or shredding (eg., disintegration) of the manure material 501 is found. This is desirable.

Indeed, trials suggest that operating the main processor 504 so as to boost the amount of flash-vapor production apparently corresponds with the near elimination (more accurately, substantial reduction) of the malodorous quality of the ultimate solid output streams 501$^{a}$ and 501$^{b}$.

The concepts of "flash vapor" production and "flash drying" are different concepts despite being denominated with the common term "flash." As described above, flash drying is a process by which material dries while suspended in a hot pneumatic carrier, as this promotes mixing and efficient heat transfer, and might be better distinguished by referencing it as "pneumatic conveyance" drying (or boiling or heating). The pneumatic stream 525 discharged by the main processor 504 carries 100% of the water vapor produced, or released by water-eliminating chemistry reactions, in the main processor 504. More significantly, the discharged pneumatic stream 525 carries away ~100% of the butyric acid vapor flashed or boiled off in the main processor 504:—of that 100%, perhaps over 85% is the produced by boiling (eg., not flashing).

In contrast, the production of "flash vapor" is a different phenomenon. And while it accounts for only a minority percentage of the vapor produced in the main processor 504, it is an important phenomenon because what it contributes to the material 501's shredding itself apart from gas expansion from the inside.

Briefly, when a saturated condensate under pressure is released to a lower pressure, part of it suddenly evaporates, becoming what is known as "flash vapor." Consider for example the case of butyric acid. The basic physics behind butyric acid's flash vapor product includes the following. When butyric acid is heated at atmospheric pressure, its temperature rises until it reaches its atmospheric-pressure boiling temperature, 164° C. (327° F.), the highest temperature at which liquid butyric acid can exist at atmospheric pressure. Additional heat does not raise the temperature, but converts the butyric acid from its liquid phase to its vapor phase. The heat absorbed by the liquid butyric acid water in raising its temperature to the boiling point is called "sensible heat." The heat of the liquid butyric acid at the boiling temperature is called the heat of saturated condensate. The heat required to convert the liquid butyric acid at boiling temperature to vapor is called "latent heat."

Note that at pressures lower than atmospheric (eg., vacuum pressures), butyric acid boils at relatively lower temperatures. Excluding the pressure regime greater than atmospheric, the latent heat of butyric acid is relatively temperature independent across the regime encompassing atmospheric and sub-atmospheric pressures. And in this regime, butyric acid's latent heat can be considered a constant. It has a value of 92.7 kcal/kg (167 Btu/lb).

If saturated butyric-acid condensate at atmospheric pressure is introduced into a partial vacuum, a certain amount of sensible heat is released. This excess heat will be absorbed in the form of latent heat, causing part of the butyric acid condensate to "flash" into vapor. To illustrate with real world values, reconsider equation (1) above except rewritten in the following fairly equivalent terms, this equation is likewise expressing the percentage of a (nearly) saturated condensate that will flash into vapor when introduced into a lower pressure:

$$\%\ \text{flash vapor}=[\{c_p\times(T_h-T_l)\}\div H]\times 100, \quad (2)$$

where $T_h$=Temperature of the condensate at the higher pressure before discharge (° C. or ° F.);

$T_l$=Boiling temperature for the condensate at the lower pressure to which discharge takes place (° C. or ° F.);

$c_p$=mean specific heat of the condensate (kcal/kg-° C. Btu/lb-° F., same difference); and H=mean latent heat in the vapor steam at the lower pressure to which the condensate has been discharged (kcal/kg or Btu/lb).

The following example values can be utilized to illustrate. If saturated butyric-acid condensate is introduced into an 0.4 atmosphere vacuum (eg., twelve inches of mercury), there is a certain instantaneous drop with the heat content of the condensate which is computed in part as given above:—$c_p\times(T_h-T_l)$. Butyric acid has the following relevant properties. At atmospheric pressure butyric acid boils at 164° C. (327° F.). At a vacuum pressure of 0.4 atmosphere (eg., twelve inches of mercury), butyric acid boils at 135° C. (275° F.). Over this range, butyric acid has a mean specific heat value of 0.515 kcal/kg-° C. (or 0.515 Btu/lb-° F.). So again, if saturated butyric-acid condensate at atmospheric is introduced into an 0.4 atmosphere vacuum, its heat content instantly drops 14.9 kcal/kg (eg., 0.515×(164−135)), which is also 26.9 Btu/lb. This surplus 14.9 kcal/kg (26.9 Btu/lb) evaporates or flashes a portion of the condensate into vapor.

Given that the mean latent heat of butyric acid is about 92.7 kcal/kg (167 Btu/lb), then the percentage of flash vapor computes to about 16 percent (eg., 14.9÷92.7). To compare the result with water, introducing saturated condensate water into a 0.4 atmosphere vacuum (eg., twelve inches of mercury) only caused about 3⅓ percent of the condensate to flash into steam. In contrast, with butyric acid, a much greater percentage is achieved, namely 16 percent. This is partly explained by the differences in latent heat values. Water's mean latent heat value (in concern of atmospheric and sub-atmospheric pressures) is about five-hundred and fifty kcal/kg (eg., one thousand Btu/lb). In any event, it is an aspect of the invention to utilize the phenomenon of flash vapor production to promote material 501's disintegration by introduction of the pre-heated material 501 into the vacuum of the main processor 504.

Moreover, it is believed that flash vapor production contributes to killing pathogens. These microbial agents might be wiped out by the high temperatures boiling off their water, or denaturing their proteins or converting their carbohydrates. However certain microbes do threaten to survive heat of the method 500' in accordance with the invention, if not for flash vapor production. It is believed that such pre-heated microbes contain some candidate compound that will flash in the main processor 504. It is further believed that such flashing literally explodes the microbes from the inside. The candidate compounds include without limitation the low-carbon members (eg., low-number count of carbon atoms in the molecule) of the organic oils and/or their derivative fatty acids.

Trial and error has taught that it is amply possible to choose the wrong output temperature for the pre-heater 506. That is, the manure stream 501 contains numerous materials which are candidate for flashing, including principally water and various other natural oils/fats and/or their derivative fatty acids. If water is chosen, the pre-heater 506's temperature has to be kept just below water's boiling temperature, which is undesirably cold for affecting oils, fats and fatty acids. Also, water only flashes to a value of 3⅓ percent of itself upon introduction into a 0.4 atmosphere vacuum.

In contrast, if a higher operating temperature for the pre-heater 506 is chosen, whereas no doubt water and low-boiling temperature materials will be long boiled off in the pre-heater 506, the boiling temperatures of other candidate materials can be approached for flash vapor purposes. At the same time, such higher temperatures will doubtlessly de-nature and/or reduce the protein and carbohydrate materials in the manure stream 501. If an operating temperature for the pre-heater 506 is chosen (not really arbitrarily, but after trial and error) to be about 160° C. (320° F.), then several candidate materials in the manure stream 501 become available for flash vapor production. Referencing the table above (in the Background section), it appears if not only butyric acid but perhaps also isobutyric acid and, maybe to a lesser extent, propionic acid and isovaleric acid, can be depended on for some percentage of flash vapor production.

Indeed there may be other materials in the manure stream 501 which may flash when taken to 160° C. (320° F.) and then introduced into a 0.4 atmosphere vacuum and are not known to date. Regardless, it is an aspect of the invention to pre-heat the manure stream 501 to a suitable (suitably high) temperature to involve several materials for flash vapor production, and then introduce such into a suitable (suitably low pressure) vacuum in order to promote as much flash vapor production as is available.

In consideration of the foregoing, it might be questioned, why not heat the manure stream 501 so hot that it reduces itself to ash? Among other reasons why not, this might lead to an explosion, so if ash is the goal it would be safer to incinerate it. More particularly, there are several reasons for not adding endless heat to the treatment. One is energy cost. It is an aspect of the invention to optimize the obtained-results against the cost of operation, namely energy cost. Two is danger. The manure material 501 will produce explosive vapors which if heated too hot will auto-ignite, if not finding from elsewhere in the environment of such machinery some slight trigger to torch off. Three is environmental pollution. Incineration would accomplish the same trick of reducing manure to ash but faster, except that environmental regulations would stipulate more expensive scrubbing and treatment of the exhaust plume. Four is a problem of accretion of gummy or molasses-like material. Drying manure tends to leave a thickening residue of gummy or molasses-like material which, after enough build-up, freezes onto surfaces and causes seize-up of machinery. Five is a problem of being a nuisance neighbor. In spite of flue gas scrubbing treatments which might meet environmental regulations (for toxicity and/or health impact), the scrubbed exhaust plume will still surely stink. In any event, ash has little commercial value while in contrast appropriately treated manure is a useful soil additive in its own right.

It is an aspect of the invention to optimize the choice of pre-heat temperature against discharge vacuum in order to enhance the self-induced destruction of the manure stream 501 to the extent practicable. Flash vapor production is to date the identified mechanism. Flash vapor production depends on, among other things, pre-heating the material 501 close to the boiling temperatures of known compounds. As mentioned above for chicken manure, it is known to contain acetic acid, butyric acid, isobutyric acid, propionic acid and isovaleric acid. Referencing the Table above (in the Background section), acetic acid can somewhat be ignored because it has the coolest boiling temperature. On the other hand, the boiling temperatures of those other components—butyric acid, isobutyric acid, propionic acid and isovaleric acid—arguably group together such that perhaps several if not all of them can be induced to flash if a reasonably calculated choice is made as to pre-heat temperature and then also vacuum pressure to discharge into.

It is another aspect of the invention to syphon up and suspend as much of the disintegrating manure stream 501 in the pneumatic stream 525 flowing through the main processor 504 to the extent practicable as well. Not only does this accomplish relatively fast-acting pneumatic-conveyance heat-exchange by way of the turbulent swirling of the suspended material in the hot pneumatic carrier 524, but it also is a control measure against the build-up of gummy or molasses-like accretions on the inside surfaces of the main processor 504.

Accordingly, it is fully another aspect of the invention to incorporate control measures against incrustation by gummy or molasses-like accretions. These have to be guarded against or else they can form rock-like incrustations that will seize-up the equipment. In the past, if incrustations were to have formed to an intolerable degree and hardened rock-hard, the only known remedy (still, to date) was/is to disassemble the equipment and manually remove the incrustations with chipping and grinding by power tools. Such is costly and time-consuming maintenance. Heavy machinery is required to disassemble the augers and ducts. The surface areas covered by the incrustations are rather substantial. Worker access to much of the covered surface-areas is awkward. Even with the best of access and tools, the time it takes to clean any patch of surface area is slow.

Hence, it is an aspect of the invention to prevent such incrustations from intolerably forming in the first place. In part, the method 500' in accordance with the invention only pre-heats the manure stream 501 to a relatively cool temperature in the pre-heater 506, or that is below temperatures before gummy and molasses-like accretions are unmanageable. In the pre-heater 506, the manure stream 501 is continually motivated along by auger(s) 507 as the manure stream 501 heats up from the local environmental (eg., ambient) temperature to the hot "introduction" temperature, ie., the temperature at which it is introduced into the main processor 504. FIG. 2 shows an example pre-heater 506 construction comprising three separate duct sections $\mathbf{508}^{n-2}$, $\mathbf{508}^{n-1}$ and $\mathbf{508}^{n}$, connected in series. Any problems with incrustation would be expected more likely in the last section $\mathbf{508}^{n}$, the manure stream 501 in it being hotter, than in either of the earlier two duct sections $\mathbf{508}^{n-2}$ and $\mathbf{508}^{n-1}$, where manure stream 501 temperatures are cooler. Optionally, for clean-out operations, the last duct section $\mathbf{508}^{n}$ in the succession might be temporarily changed out of the treatment line 500 and cleaned while still leaving the treatment line 500 as whole functional on all but-the-last duct sections $\mathbf{508}^{n-2}$ and $\mathbf{508}^{n-1}$ during the temporary time needed to clean-out the last duct section $\mathbf{508}^{n}$.

In the main processor 504, various innovations are incorporated to manage incrustation problems. One, the pre-heated manure stream 501 is immediately subjected to flash vapor production by way of introduction into a hot vacuum environment. Two, thereafter the process of pneumatic conveyance suspension and drying in a hot pneumatic carrier 524 keeps the bulk of the introduced manure stream 501 away from solid contact with the duct 512's walls, the ribbon-screw $\mathbf{514}^{1}$, spokes $\mathbf{514}^{3}$ and/or drive shaft $\mathbf{514}^{2}$. Three, for the non-suspended residuals 527 of the manure stream 501, these are channeled (eg., pushed) along a virtual bed or sluiceway of the duct 512 in such a way as to minimize upward spread onto the virtual sidewall(s) and or/ceiling of the duct 512. That way, coating by the non-suspended residuals 527 is at least practically eliminated for the drive shaft $\mathbf{514}^{2}$ and about three-quarters of the duct 512. It is preferred not to include cut-and-fold mixing flights or mixing paddles in the main processor 504's auger 514 because it is preferred instead to simply confine as best possible the non-suspended residuals 527 of the manure stream 501 to the virtual bed or sluiceway of the duct 512.

In view of the foregoing, it is a goal with the pre-heater 506 to do the following. That is, to warm up the raw manure stream 501 to a temperature above what corresponds to a boiling point at the pressure inside the main processor 504 for certain flash materials (eg., butyric, isobutyric, propionic and isovaleric acid &c.) without actually taking the manure stream 501 over the boiling point for such at atmospheric pressure (or whatever operating pressure for the pre-heater 506, it being contemplated that higher is better). For example, if the vacuum pressure in the main processor 504 is a 0.4 atmospheres (twelve inches of mercury), then butyric acid will boil not at 164° C. (327° F.) but 135° C. (275° F.). Hence the goal with the pre-heater 506 is to warm up the manure stream 501 to as much over 135° C. (275° F.) that is deemed acceptable without, needless to say, going much over 164° C. (327° F.), or at least for very long. In other words, it is not an object of the pre-heater 506 to boil away all the flash-susceptible materials at this stage, but simply heat them to a state nearly that of a saturated condensate or, if the mean temperature creeps above any flash-susceptible material's boiling temperature, then to keep the time-span during which that occurs to very short before introducing the pre-heated material 501 into the main processor 504. That way, despite the mean temperature creeping above some component's boiling temperature, in a transient state this will not happen over long enough time to complete that component's opportunity to fully boil off.

Thus the pre-heater 506 with its heated walls 508 and auger shaft $\mathbf{507}^{2}$ gently warms and stirs the material 501 in transit. Preferably the pre-heater 506's auger screw(s) $\mathbf{507}^{1}$ also has/have a cut-and-fold arrangement for tumbling the material 501 on its way to being introduced in the main processor 504. This promotes disintegration and avoids clump-formation as well as avoids any input material 501 being in direct contact for too long with the hot walls 508 or auger shaft $\mathbf{507}^{2}$. It also promotes uniform temperature distribution throughout the material 501 and so eliminates hot and/or cold spots.

When the pre-heated material 501 is introduced into the main processor 504, it is first ground up. Here if not more immediately sooner is where presumably the production of flash vapor occurs. It is an object of the invention that as soon as the input material 501 enters the vacuum, flash vapor production is underway as immediately as practicable.

The choice over how hot and how abundant (eg., what flowrate) to make the pneumatic carrier 524 involves several decisions. First, it is desirable to make the pneumatic carrier 524 as about as hot as the pre-heater 506 (eg., 160° C. or 320° F.). That is, the pneumatic carrier 524 should be sufficiently hot and abundant to promote as efficient as possible pneumatic-conveyance heat-exchange, given the material 501's residence time in the main processor 504. Of course, the pneumatic carrier 524's temperature will drop as a result, and the drop will be a function of the heat accepted by the pneumatic carrier 524 against the latent heat of vaporization of the vaporizing components. If the pneumatic carrier 524 is more abundant, it can accept as more heat, the same as being hotter but less abundant. More simply, the pneumatic carrier 524 should be about as "hot" and abundant as an operator can get away with to achieve efficiency with pneumatic-conveyance heat-exchange and as a result sufficiently "cook" the suspended material. There is a practical ceiling on how "hot" to make the inlet pneumatic carrier 524. The practical ceiling is determined by factors such as not wanting to cause detonation of combustible vapors, or conserving energy costs. As will be described more particularly below, the end-of-line for the pneumatic carrier 524 is exhaust in a plume out a stack or chimney. A plume of needlessly-hot gas is costly. About as much energy should be consumed for heating the pneumatic carrier 524 to a temperature sufficient to achieved the objects of the invention.

The flash vapor production is strongly believed to contribute significantly to the physical destruction of the manure, as well as promote chemical reduction processes upon other unwanted molecules in the manure. If the temperature and vacuum application is done right, the pneumatic stream 525 will suspend and carry away 85% weight fraction of the input manure 501.

An example of operating conditions includes the following. A target throughput of manure material 501 preferably is processed through at a rate of about nine thousand kg (ten tons) per hour. The pneumatic carrier 524 is introduced into the main processor 504 at about 150° C. (~300° F.). The pressurized steam 516 circulating through the main processor 504's thermal components is targeted to keep the duct 512's walls and auger at about 160° C. (~320° F.). The flowrate of the pneumatic carrier 524 is fairly unregulated before introduction, and in fact is fairly a product of whatever results from regulating the vacuum pump 535 to hold the main processor 504's pressure at about a 0.4 atmosphere vacuum (twelve inches of mercury). Indeed, the vacuum pump 535 is practically run wide open with little regulation. Hence the main processor 504' vacuum level as well as the pneumatic carrier 524's flowrate is about as much as the vacuum pump 535 can handle under the circumstances.

It is an option to hang the main processor 504 from electronic scales (not shown). An automation system might be arranged for controlling introduction of the input material 501 into the main processor 504. If the scales measure changes in weight with the main processor 504 (ie., due to imbalance of the rates of material 501 and 524 in against material 525 and 526 out), the automation system might engage in proportionate control over, among other options, the rate of feed of input material 501 in order to level off imbalance.

Attention will now be turned to the treatments the pneumatic stream 525 undergoes after exiting the main processor 504. Trials have found that as much as 85% weight fraction of the input manure 501 exits out the main processor 504 with the pneumatic carrier 524. By way of background, the vacuum pump 535 is disposed downline from the main processor 504, from which position it suctions away the pneumatic carrier 524 as well as the vapors and perhaps ultra-fine particulate matter. A trunk (eg., main) vacuum line 536 extends from an origin at the main processor 504's vacuum port 526 to a termination at the vacuum pump 535. The vacuum pump 535 pulls most immediately, however, on a regulator valve 538.

The regulator valve 538 provides control over the level of vacuum pulled throughout the rest of the system 500. By way of background, large vacuum pumps are not only costly but also typically rated for just one working load only. They simply lack adjustment features for regulating the working load. Hence the chosen vacuum pump has a duty rating perhaps in excess of what is needed, and the actual operating pressures in the system 500 are regulated to what is wanted by custom regulating valves 538 (and also 560, described more particularly below). Hence FIG. 1B shows the vacuum pump 535 pulling directly on a primary regulator valve 538. If used, the regulator valve 538 allows bleeding in a little room air in order to dilute the strength of the vacuum pump 535.

As a matter of practical consideration, it is more efficient to avoid regulation as the suctioned in air simply dilutes the efficiency of the vacuum pump. It is however desirable to utilize the regulator valve 538 for some modest degree of regulation because otherwise an operator has no control over the vacuum level except to shut down.

Situated in between the main processor 504 and the vacuum pump 535 is at least some form of particle separation system (eg., as indicated generally by 540). An example comprises a cyclone separator 540. It operates to divide the received pneumatic stream 525 into two, namely, one stream 501$^{e}$ being vented out the exhaust pipe and onward to the vacuum pump 535 and another stream 501$^{a}$ comprising substantially finely shredded particles of soft flake.

The vent stream 501$^{e}$ comprises the pneumatic carrier 524, vapors and perhaps ultra-fine particulate matter. The particle stream 501$^{a}$ drains out the bottom of the cyclone separator 540 and transits through an air-lock gate 542 in order to preserve the vacuum in the cyclone 540 as well as the main processor 504. At this point, the particle stream 501$^{a}$ empties out into or onto some collection or conveyor system 543.

This particle stream 501$^{a}$ is a final product. It is a substantially dry and non-oily, finely shredded, soft flake derivative of the raw input manure 501. Because of evaporation in the pre-heater 506 and main processor 504, the particle stream is also substantially ammonia free as well as fatty-acid free. The particle stream 501$^{a}$ is substantially less malodorous than the raw input manure 501 which (even though "odor" is a subjective quality as explained in U.S. Pat. No. 4,070,300—Moroni, et al.) is readily explainable. Many of the odor-producing compounds have either been changed into other compounds or have been evaporated out of the dry particulate stream 501$^{a}$ and now travel with the vent stream 501$^{e}$.

Indeed, the particle stream 501$^{a}$ represents a relatively minuscule weight fraction of the raw manure input 501. Even though 85% weight fraction of the raw manure input 501 entering the pre-heater 506 exits with the pneumatic stream 525 from the main processor 504, the particle stream 501$^{a}$ might represent just 10% weight fraction. Accordingly, it is this 10% weight fraction stream 501$^{a}$ which is available for long distance shipping for spreading on fields where shipping-cost containment is paramount. This particle stream 501$^{a}$ is compact too. Whereas what may have been ten truckloads of raw manure 501 is reduced by the treatment 500' in accordance with the invention to something like one truckload.

Correspondingly, the vent stream 501$^{e}$ contains many vapors and gaseous compounds. The vent stream 501$^{e}$ transits through the vacuum pump 535 and exhausts out an exhaust stack 545 as shown in FIG. 8.

Figure 9:
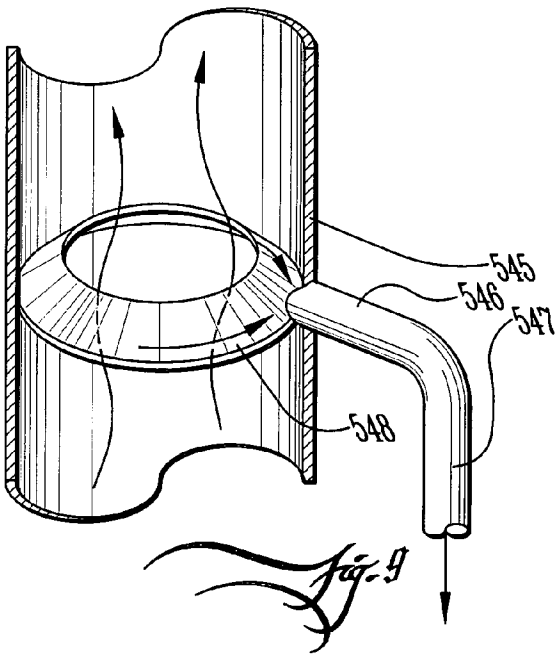
FIG. 9 is an enlarged scale partial sectional view taken in the direction of arrows IX—IX in FIG. 8.
Figure 8:
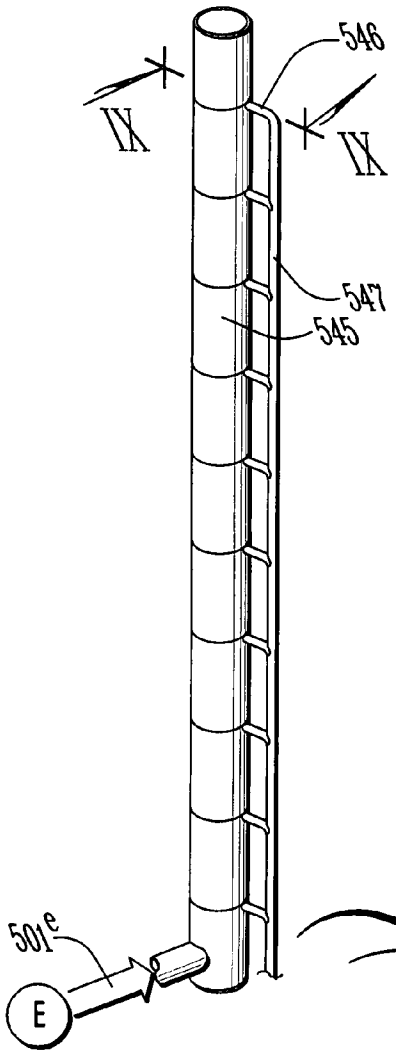
FIG. 8 is a perspective view of an example exhaust stack for the vacuum pump exhaust and for carrying out succeeding treatment activities, as succeeding encircled continuation element "E" that is referenced in FIG. 1B.

In FIG. 8, the exhaust stack 545 is serviced by a ladder-like drain system which has multiple drain pipes 546 tapped into the exhaust stack 545 at spaced elevations and feeding a common down spout 547. FIG. 9 shows inside the exhaust stack 545 where indicated by arrows VI—VI in FIG. 8, and as representative of the multiple other elevations where a drain pipe 546 taps into the wall of the exhaust stack 545. Accordingly, each drain pipe 546 is associated with a hoop ring gutter 548. As condensates (eg., ammonia among others) cool while rising up the exhaust stack 545, presumptively they fall back down if not form on the relatively cooler sidewalls. The numerous terraces of gutters 548 are distributed inside the exhaust stack 545 to catch such condensates, and channel the caught condensate to the drains 546 which in turn feed the down spout 547. The down spout 547's output can in turn be processed through separation techniques not part of the invention in order to recover valuable compounds (such as ammonia), or contaminated fractions not suitable for public water-treatment utilities (or agricultural irrigation) and thus have to be held back for special further treatment also not part of the invention.

Referring back to the main processor 504's drain 528, what exits out there is a non-suspended residual stream 527. Albeit a stream of about 15% weight fraction of the input stream 501, the non-suspended residual stream 527 is deemed insufficiently treated at this stage. Hence the residual stream 527 is introduced into a residual dryer 550.

Figure 6:
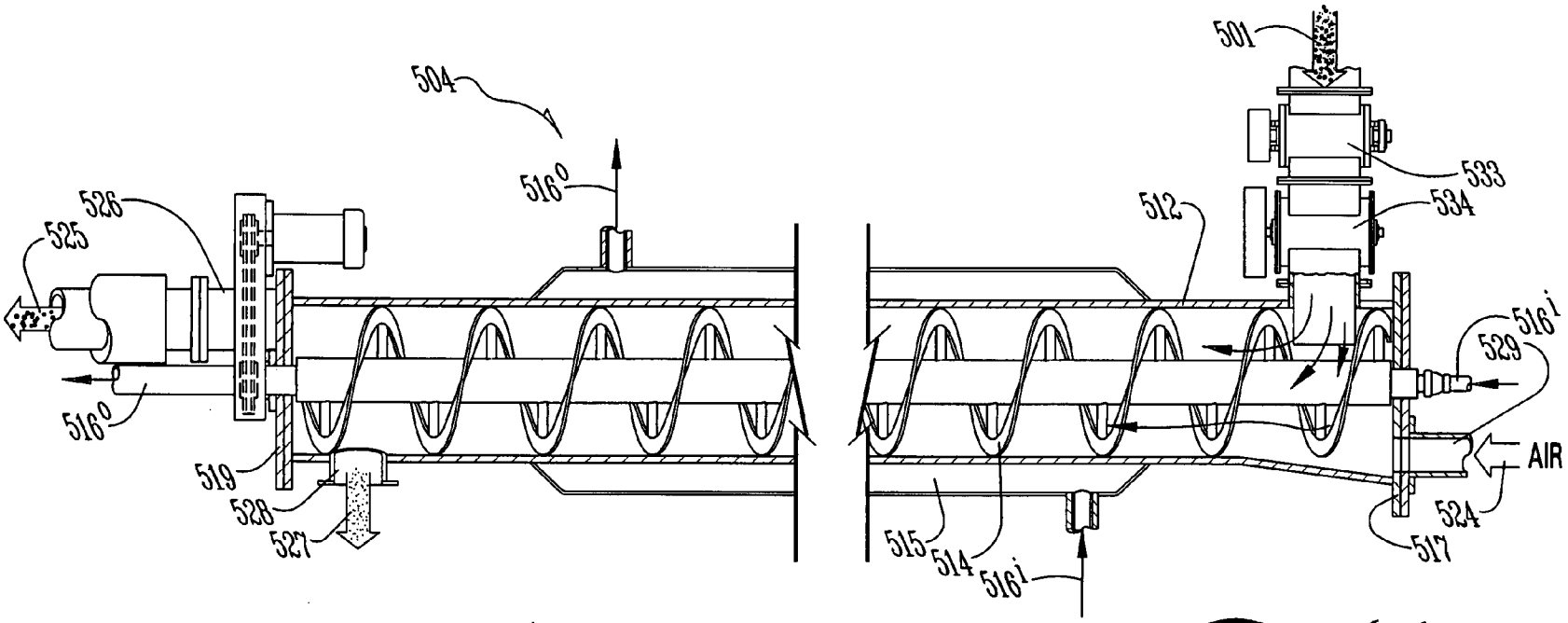
FIG. 6 is an elevational view, partly in section, of an example apparatus for carrying out the activities of a "residual dryer" as referenced in FIG. 1B.

The residual dryer 550 shares similarities with the main processor 504. The residual dryer comprises an elongated duct 552 carrying a comparably elongated ribbon auger 553. With reference to FIGS. 2 and 6, a preferred construction for a residual dryer 550 comprises a duct 552 arranged horizontally and housing the internal auger 553. Since the residual dryer 550 is also heated, preferably the duct is surrounded by a jacket 554 for circulating an appropriate thermal fluid (eg., steam) 516$^{i}$ and 516$^{o}$. The auger 553 preferably has a hollow drive shaft 553$^{2}$ for circulation of a thermal fluid through it as well.

The duct 552 of the residual dryer 550 extends between an introduction end 556$^{i}$ and an axially-spaced away discharge end 556$^{o}$. The auger 553's outer periphery essentially scrapes the duct 552's wall from end to end. FIG. 7 shows better that the auger 553 comprises more particularly a ribbon auger. It has a ribbon screw 553$^{1}$ supported by a series of spokes 553$^{3}$ that support the ribbon screw 553$^{1}$ spaced away from the central hollow drive shaft 553$^{2}$. In order to achieve optimal drying in the residual dryer 550, clearance is needed. The space between the ribbon auger's spokes 553$^{3}$ provides that clearance. The ribbon screw 553$^{1}$ acts both to motivate material in the direction toward the discharge end 556$^{o}$ while scraping gummy substances off the duct 552's wall. This ribbon screw 553$^{1}$ construction helps prevent the build-up of gummy or molasses-like accretions on the central drive shaft 553$^{2}$. Unlike the main processor 504's auger, the spokes 553$^{3}$ of the residual dryer 550's auger are formed with trailing flanges or "flights" to develop tumbling and/or cut-and-fold action. This breaks up clumps as well as tumbles the material 527, instead of just pushing it smoothly across the virtual bed of the duct 552 (as is done in the main processor 504). Presumptively the flighted spokes 553$^{3}$ loft or kick up some amount of material 527 so that it might more easily be syphoned up and suspended by the pneumatic carrier 551.

An example residual dryer 550 might measure without limitation about 5 meters (sixteen feet) long. The duct 512 preferably has an inside diameter of about seventy-six cm (thirty inches I.D.). An example auger 553 might have a twenty cm (eight inch) pitch. It may be noted that this corresponds to something approaching an "ultra fine" thread, it being more customary in the design of augers to make pitch equal to outside diameter. If the auger 553 is driven at a speed about five r.p.m., then the auger 553 very generally pushes material 527 across its effective length in about five minutes. Longer residence times can be obtained by slowing down the speed of the auger 553.

The introduction end 556$^{i}$ is adapted to receive the non-suspended residual material 527 continuously along at the same time with a continuous injection or influx of the "pneumatic carrier" 551, ie., a hot dry clean gas. The duct discharge end 556$^{o}$ is adapted to discharge (i) a "pneumatic stream" 555 out a suction port as well as (ii) discharge a non-suspended output stream 559 out a drain. FIG. 6 shows the pneumatic carrier 555 being introduced through an inlet port that is located at a relatively low elevation on the introduction end 556$^{1}$, as the input non-suspended residual stream 527 is introduced from above, which helps promote mixing. The suction port is shown to comprise simply an aperture in the discharge end 556$^{o}$.

Also unlike the main processor 504, the residual dryer 550 is not held under a vacuum. FIGS. 1*a* and 1*b* include various mock vacuum gauges to provide a relative comparison of the level of vacuum in the various vacuum components of the apparatus 500. The residual dryer 550 is shown operating at approximately the local environment's barometric pressure. FIGS. 1B and 2 show that the source of the pneumatic carrier 551 for the residual dryer is simply room air being drawn in, perhaps filtered. During transit through the residual dryer 550, toward exit through the suction port, the pneumatic carrier 551 picks up among other things heat, from both the already hot input material 527 as well as from the heat-exchange service of the steam 516$^{i}$ supplied to the residual dryer 550. So again unlike the main processor 504, the pneumatic carrier 551 here enters the residual dryer 550 cold but exits hotter. Indeed the pneumatic stream 555 exiting the residual dryer 550 is so hot it is usefully recycled and fed into the main processor 504 as the pneumatic carrier 524 inputted there.

By the time the air or "pneumatic" carrier 555 exits the residual dryer 550 through the suction port it additionally carries with it a minor vapor content that has been vaporized out of the input non-suspended residual material 527. There is likely as well as minor weight fraction of suspended, entrained or waftable materials. By way of being fed through the main processor 504, these minor weight fractions of vapor and suspended material will be fed forward for separation at the main cyclone separator 540, and the vapors will be dealt with as described in connection with FIG. 8. It is presumed that the vapor content here comprises very little water but perhaps vapors cooked off various organic compounds or else organic vapors of reduction products, such as alcohols or phenols and the like. Some reduction reactions eliminate water, and hence there is still some slight water content in the pneumatic exit stream 555.

FIG. 2 shows that, in order to preserve the vacuum in the main processor 504, the non-suspended drain material 527 from the main processor 504 is exited through an air-lock gate 544. It also is preferred to grind up the exiting non-suspended residual material 527 prior to introduction into the residual dryer 550 in order to break apart clumps and the like. In contrast, whereas FIG. 1B shows that the non-suspended output stream 559 from residual dryer 550 is likewise exited through an air lock gate 557 (and grinder 558), this is not done to preserve a vacuum in the residual dryer 550 (because there is none) but to prevent the suction from downline devices from scavenging the pneumatic carrier 551 from the residual dryer 550.

Ultimately, the residual dryer 550 discharges the non-suspended output stream 559. This non-suspended output stream 559 has a slightly different composition than the soft-flake output from the main processor 504's that is suspended in its pneumatic stream 525. For instance, residual dryer 550's non-suspended output stream 559 is relatively more brittle.

This output residual material 559 is fed to a further separation system 565. An example output residual separation system 565 comprises one or more cyclone separators $\mathbf{565}^{i}$ and/or $\mathbf{565}^{2}$. However, it is preferred if a regulated bleed valve 560 is situated in between the last-mentioned grinder 558 and these one or more cyclone separators $\mathbf{565}^{i}$ and/or $\mathbf{565}^{2}$. The residual dryer 550's discharge air-lock gate 557 does more than just prevent scavenging of the pneumatic carrier 551 inside the residual dryer 550. It also allows downstream treatments for the output residual material 559 to likewise be undertaken under a vacuum, but at a different level than that for the main processor 504. Hence the main processor 504 operates at the lowest pressures in the system 500. The pre-heater 506 and residual dryer 550 are shown in this example to operate at comparably the same level, ie., the local barometric pressure but, importantly, there is no link between the respective operative pressures for the pre-heater 506 and/or residual dryer 550. Hence it may be desirable to change things for one of the two, like for example operating the pre-heater 506 under a moderately pressurized state.

That aside, the treatments to be described next for the output residual material 559 are also undertaken under a vacuum, but at an intermediate level about halfway between the main processor 504's vacuum pressure and local barometric. The residual dryer 550's regulated bleed valve 560 also allows an influx of a pneumatic carrier 561 in order that the separation treatments of the further cyclone separators $\mathbf{565}^{1}$ and/or $\mathbf{565}^{2}$ work without choking for absence of a pneumatic medium. In this instance, the pneumatic carrier 561 is truly air, and is simply suctioned in from the local environment (eg., the room). The air is not heated (but preferably filtered), and hence the pneumatic carrier 561 admitted at this point is simply ambient (eg., room) temperature air.

In any event, the output residual material 559 might be optionally be fed to a fragmenting cyclone separator $\mathbf{565}^{1}$. A fragmenting cyclone separator $\mathbf{565}^{1}$ does at least two jobs. One job is conventional for cyclone separators, and that being separating the input into an exhaust of a pneumatic stream 567 and a drain of relatively-heavier particulate material 568. The other job is to promote further disintegration or "fragmenting" by smashing the material to bits against flat walls. That is, an example fragmenting cyclone $\mathbf{565}^{1}$ separator has not a smooth conic wall but a wall of flat panels at angles from one another, such as a "frustum" having a hexagonal cross-sectional shape. The tangential injection of the output residual material 559 smashes against these panels and thereby is likely to promote further disintegration. The fragmenting cyclone $\mathbf{565}^{1}$ provides a pneumatic exhaust 567 out a top vent as well as a relatively-heavier particulate material discharge 568 through a drain in the bottom.

The pneumatic exhaust 567 of the fragmenting cyclone $\mathbf{565}^{1}$ is ultimately piped back into the vacuum trunk line 536 between the main processor 504 and the main cyclone 540. The pneumatic exhaust 567 of the fragmenting cyclone 5651 includes the pneumatic carrier 561, vapors, and ultra-fine or ultra-light suspended matter which may be worth attempting to catch and drop at the main cyclone 540 to the extent practicable.

The drain stream 568 of the fragmenting cyclone $\mathbf{565}^{1}$ might be acceptable as complete. If so, it would have to be transited through an air-lock gate in order to preserve the vacuum pressure inside the fragmenting cyclone $\mathbf{565}^{1}$.

Alternatively, as FIG. 1B shows, the drain stream 568 of the fragmenting cyclone $\mathbf{565}^{1}$ might be fed to a residual cyclone separator $\mathbf{565}^{2}$, preferably a smoothly conical one, in order to further complete the syphoning away of ultra-fine and/or ultra-light suspended matter. The residual cyclone $\mathbf{565}^{2}$ provides a drain stream $\mathbf{501}^{b}$ that is another target end-product of the method 500' as is the stream $\mathbf{501}^{a}$. The drain stream $\mathbf{501}^{b}$ from the residual cyclone $\mathbf{565}^{2}$ empties out through an air-lock gate 571, and is collected or conveyed and the like elsewhere. This is the end-of-the line for the stream $\mathbf{501}^{b}$.

The pneumatic exhaust 572 suctioned out the vent of the residual cyclone $\mathbf{565}^{2}$ is preferably piped back into the main vacuum trunk line 536 leading into the membrane cyclone 540. It may additionally include a small weight fraction of membrane matter which is worth attempting to catch at the main cyclone separator 540 to the extent practicable.

The treated solid streams $\mathbf{501}^{a}$ and $\mathbf{501}^{b}$ obtained by the method 500' in accordance with the invention is useful for cross-country freighting in bulk to remote and sparsely distributed agricultural fields for spreading across as a soil additive. This provides several advantages. A high-density livestock operation such as high-rise egg-laying chicken houses and the like are afforded a cost effective solution to disposition of the mounds of manure produced thereby. Also, remote and sparsely distributed agricultural fields across the nation are now more than ever within economic reach of receiving a valuable soil additive. The treated solid streams $\mathbf{501}^{a}$ and $\mathbf{501}^{b}$ are substantially if not absolutely pathogen-free. The ammonia (and/or other compounds) extracted from the exhaust plume $\mathbf{501}^{e}$ is useful for re-sale elsewhere, as there is a substantial market for ammonia.

Moreover, the invention provides an environmentally "green," or friendly or protective, solution to manure disposition. In addition, the invention operates to contain many nuisance odors and thus helps make high-density livestock operations good neighbors in their communities.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method for treating a waste stream for reduction in part to a solid particulate fraction that is suitable for bulk freighting to remote and widely distributed destinations, comprising the steps of:

supplying a raw waste stream inclusive of natural fatty acids and/or natural oils or fats;

providing a main processor that operates at a level of vacuum;

at a relatively elevated pressure, pre-heating the waste stream in order to elevate the mean bulk temperature to above what corresponds to a boiling temperature at the main processor's vacuum level for one of the natural fatty acids and/or natural oils or fats without boiling said one away;

introducing the pre-heated waste stream into the main processor whereby a fractional percentage of said one of natural fatty acid and/or natural oil or fat flashes into vapor, this presumptively promoting the waste stream for disintegrating into a solid particulate fraction suitable for bulk freighting;

providing the main processor with a throughput of a hot pneumatic carrier for syphoning up and suspending particles of the solid particulate fraction from out of the disintegrating waste stream;

providing a vacuum source connected to a vacuum port in the main processor to suction out a pneumatic stream comprising the pneumatic carrier, vapors, and suspension particles; and further comprising a separation process between the vacuum source and the vacuum port of the main processor to separate the pneumatic stream into one component or set of components comprising substantially particulate matter as well as into another component or set of components comprising variously the pneumatic carrier, vapors and perhaps ultra-fine particulate matter.

2. A method for treating a waste stream for reduction in part to a solid particulate fraction that is suitable for bulk freighting to remote and widely distributed destinations, comprising the steps of:

supplying a raw waste stream inclusive of natural fatty acids and/or natural oils or fats;

providing a main processor that operates at a level of vacuum;

at a relatively elevated pressure, pre-heating the waste stream in order to elevate the mean bulk temperature to above what corresponds to a boiling temperature at the main processor's vacuum level for one of the natural fatty acids and/or natural oils or fats without boiling said one away;

introducing the pre-heated waste stream into the main processor whereby a fractional percentage of said one of natural fatty acid and/or natural oil or fat flashes into vapor, this presumptively promoting the waste stream for disintegrating into a solid particulate fraction suitable for bulk freighting; and further providing the main processor with a throughput of a hot pneumatic carrier for syphoning up and suspending particles of the solid particulate fraction from out of the disintegrating waste stream;

wherein the hot pneumatic carrier comprises a hot dry clean gas including hot air or hot flue/exhaust gases from a combustion process.

3. The method of claim 2 further comprising a vacuum source connected to a vacuum port in the main processor to suction out a pneumatic stream comprising the pneumatic carrier, vapors, and suspension particles.

4. The method of claim 3 further comprising a separation process between the vacuum source and the vacuum port of the main processor to separate the pneumatic stream into one component or set of components and another component or set of components, wherein said one component or set of components comprises substantially particle matter as said other component or set of components comprises variously the pneumatic carrier, vapors and perhaps ultra-fine particulate matter.

5. The method of claim 1 wherein the hot pneumatic carrier comprises a hot dry clean gas including hot air or, alternatively, hot flue/exhaust gases from a combustion process.

6. The method of claim 2 wherein the level of vacuum inside the main processor is preferably achieved down to or below essentially $2/3^{rds}$ an atmosphere.

7. The method of claim 6 wherein the level of pressure with the pre-heating process comprises generally the local barometric pressure of the geographic vicinity where said method is being carried out.

8. The method of claim 2 wherein and said pre-heated waste stream is introduced into the main processor at a mean bulk temperature measuring over 135° C.

9. The method of claim 1 wherein the level of vacuum inside the main processor is preferably achieved down to or below essentially $2/3^{rds}$ an atmosphere as the relatively elevated pressure of the pre-heating process comprises generally the local barometric pressure of the geographic vicinity where said method is being carried out.

10. The method of claim 1 wherein said pre-heated waste stream is introduced into the main processor at a bulk temperature measuring over 135° C.

* * * * *